US006434767B1

(12) United States Patent
Welsh, Jr.

(10) Patent No.: US 6,434,767 B1
(45) Date of Patent: Aug. 20, 2002

(54) FLOOR SUPPORT FOR BASSINET MOUNTED IN A PLAY YARD

(75) Inventor: Thomas J. Welsh, Jr., Aurora, IL (US)

(73) Assignee: Kolcraft Enterprises, Inc., Chicago, IL (US)

( * ) Notice: Subject to any disclaimer, the term of this patent is extended or adjusted under 35 U.S.C. 154(b) by 0 days.

(21) Appl. No.: 09/765,955

(22) Filed: Jan. 18, 2001

(51) Int. Cl.[7] ..... A47D 13/06
(52) U.S. Cl. ..... 5/93.2; 5/98.3; 5/99.1
(58) Field of Search ..... 5/93.2, 97, 98.1, 5/98.3, 99.1

(56) References Cited

U.S. PATENT DOCUMENTS

| | | | | |
|---|---|---|---|---|
| 534,434 A | | 2/1895 | Frost | |
| 961,669 A | | 6/1910 | Atkinson | |
| 1,204,416 A | | 11/1916 | Doser | |
| 1,413,068 A | | 4/1922 | Stotler et al. | |
| 1,574,226 A | | 2/1926 | Ackermann | |
| 2,287,907 A | | 6/1942 | Schettler, Jr. | 5/98 |
| 2,553,087 A | | 5/1951 | Hanson | 5/93 |
| 2,691,177 A | * | 10/1954 | Leonard | 5/98.3 |
| 2,784,420 A | * | 3/1957 | Moltane | 5/285 |
| 2,809,382 A | | 10/1957 | Jackson | 5/99 |
| 3,018,493 A | * | 1/1962 | Wittbrodt | 5/182 |
| 3,206,772 A | | 9/1965 | Sarasin | 5/99 |
| 3,311,935 A | | 4/1967 | Petty | 5/109 |
| 3,644,947 A | | 2/1972 | Padera | 5/92 |
| 3,735,430 A | | 5/1973 | Platz | 5/118 |
| 4,070,716 A | | 1/1978 | Satt et al. | 5/99 |
| 4,750,223 A | | 6/1988 | D'Arcy et al. | 5/99 B |
| 4,921,369 A | | 5/1990 | Chew, II et al. | 403/171 |
| 4,945,584 A | | 8/1990 | LaMantia | 5/97 |
| 5,339,470 A | | 8/1994 | Shamie | 5/98.1 |
| 5,349,709 A | | 9/1994 | Cheng | 5/93.1 |
| 5,553,336 A | * | 9/1996 | Mariol | 5/93.1 |
| 5,555,577 A | | 9/1996 | Volpe | 5/93.1 |
| 5,778,465 A | * | 7/1998 | Myers | 5/93.1 |
| 5,845,349 A | * | 12/1998 | Tharalson et al. | 5/93.1 |
| 5,862,548 A | | 1/1999 | Gerhart | 5/93.1 |
| 5,867,850 A | | 2/1999 | Mariol | 5/93.2 |
| D407,914 S | | 4/1999 | Mariol et al. | D6/391 |
| D407,915 S | | 4/1999 | Mariol et al. | D6/391 |
| 5,991,944 A | * | 11/1999 | Yang | 403/231 |
| 6,035,466 A | * | 3/2000 | Homeyer | 5/93.1 |
| 6,192,535 B1 | | 2/2001 | Warner, Jr. et al. | 5/93.1 |
| 6,233,759 B1 | | 5/2001 | Warner, Jr. et al. | 5/99.1 |

OTHER PUBLICATIONS

Century Fold–N–Go™ Care Center Brochure.
Nine (9) color photographs of playyard/bassinet combination sold by Cosco® under the tradename "Funsport".

* cited by examiner

*Primary Examiner*—Michael F. Trettel
(74) *Attorney, Agent, or Firm*—Marshall, Gerstein & Borun.

(57) ABSTRACT

A portable collapsible bassinet for suspension in a play yard is disclosed. The bassinet includes floor support bars disposed within fabric tunnels in the floor of the bassinet. The support bars each comprise at least two portions that are secured together by a spring element. The floor support bars provide even support for infants disposed in the bassinet. When not in use, the portions of the floor support bars can be disengaged to allow the bassinet to be folded into a compact position. The support bars and other components remain secured to the bassinet when erected and/or collapsed to eliminate the possibility of lost parts.

42 Claims, 8 Drawing Sheets

FLOOR SUPPORT FOR BASSINET MOUNTED IN A PLAY YARD

FIELD OF THE INVENTION

The invention relates generally to bassinets, and, more particularly, to a floor support for a bassinet mounted in a play yard.

BACKGROUND OF THE INVENTION

In recent years, portable bassinet-play yard combinations have become increasingly popular. In general, such bassinets are used by sleeping infants or new mothers who want to minimize lifting and bending associated with routine tasks such as changing and dressing babies. Bassinets typically have four sides and a floor which define an enclosed volume for an infant. Such bassinets typically rest on a ledge in the upper area of a play yard or are suspended from the upper rails of the walls of a play yard.

The walls and floor of the portable bassinets are typically made of fabric material. This material allows for the bassinet to be easily folded into a portable position.

SUMMARY OF THE INVENTION

In accordance with an aspect of the invention, a portable collapsible bassinet is disclosed. The portable collapsible bassinet includes a plurality of walls, each of which has a base edge and a free edge. It also includes a floor.

Each wall is attached to the floor and extends upward to define a pocket suitable for receiving an infant. The bassinet also includes at least one floor support bar secured to the floor and including at least two separable portions.

In accordance with another aspect of the invention, a play yard-bassinet combination is disclosed. The play yard includes a collapsible frame. It also includes a plurality of fabric walls supported by the frame. The play yard also includes a play yard floor supported by the frame. The walls extend upward from the play yard floor to define a volume. The bassinet includes a plurality of bassinet walls each of which has a base edge and a free edge. It also includes a bassinet floor. Each of the bassinet walls extends upward from the bassinet floor to define a pocket suitable for receiving an infant. The bassinet also includes at least one floor support bar coupled to the bassinet floor. The at least one support bar includes at least two separable portions.

Other features and advantages are inherent in the disclosed apparatus or will become apparent to those skilled in the art from the following detailed description and its accompanying drawings.

DETAILED DESCRIPTION OF THE PREFERRED EMBODIMENTS

Figure 1:
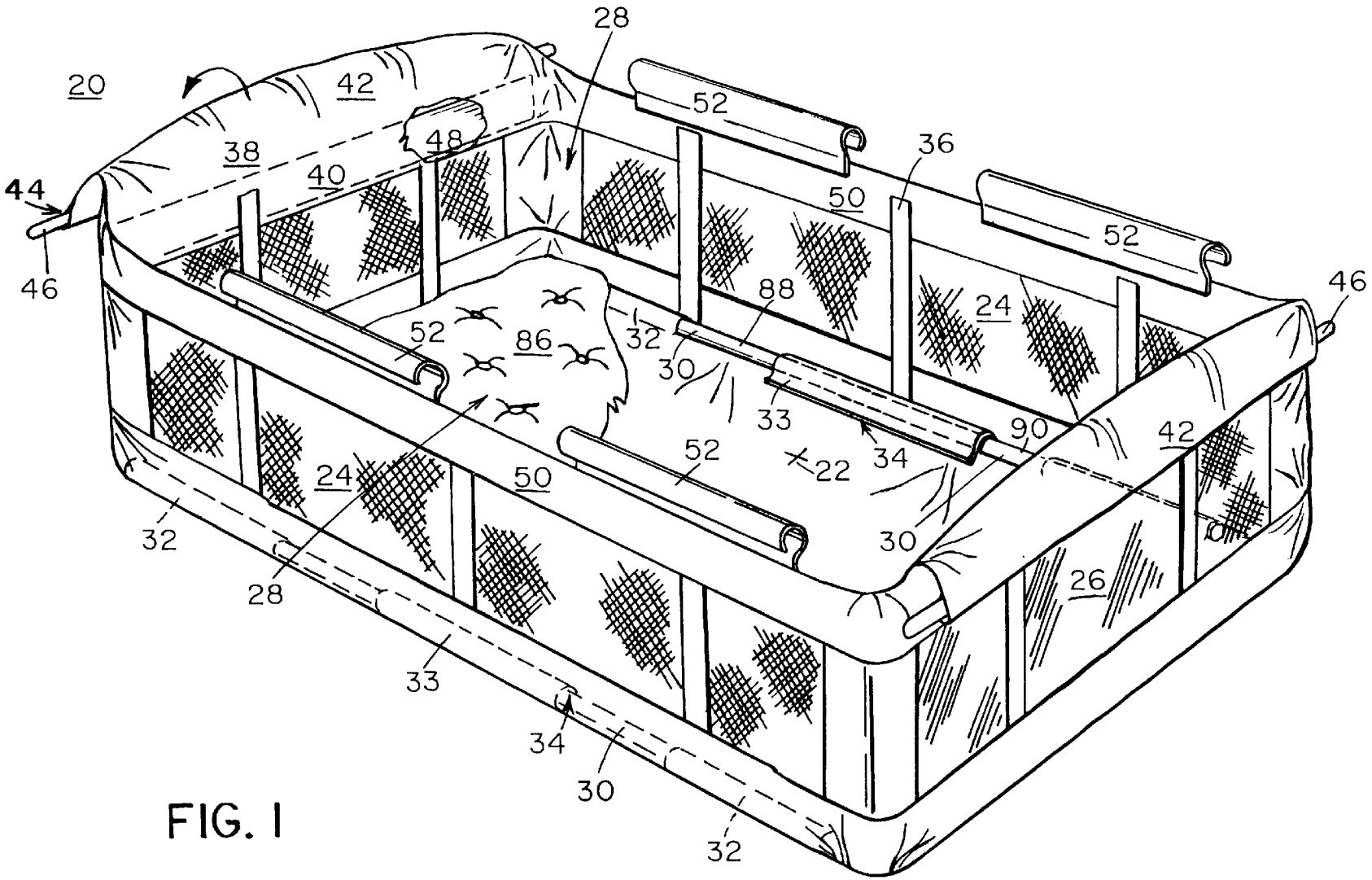
FIG. 1 is a perspective view of a bassinet constructed in accordance with the teachings of the instant invention.
Figure 2:
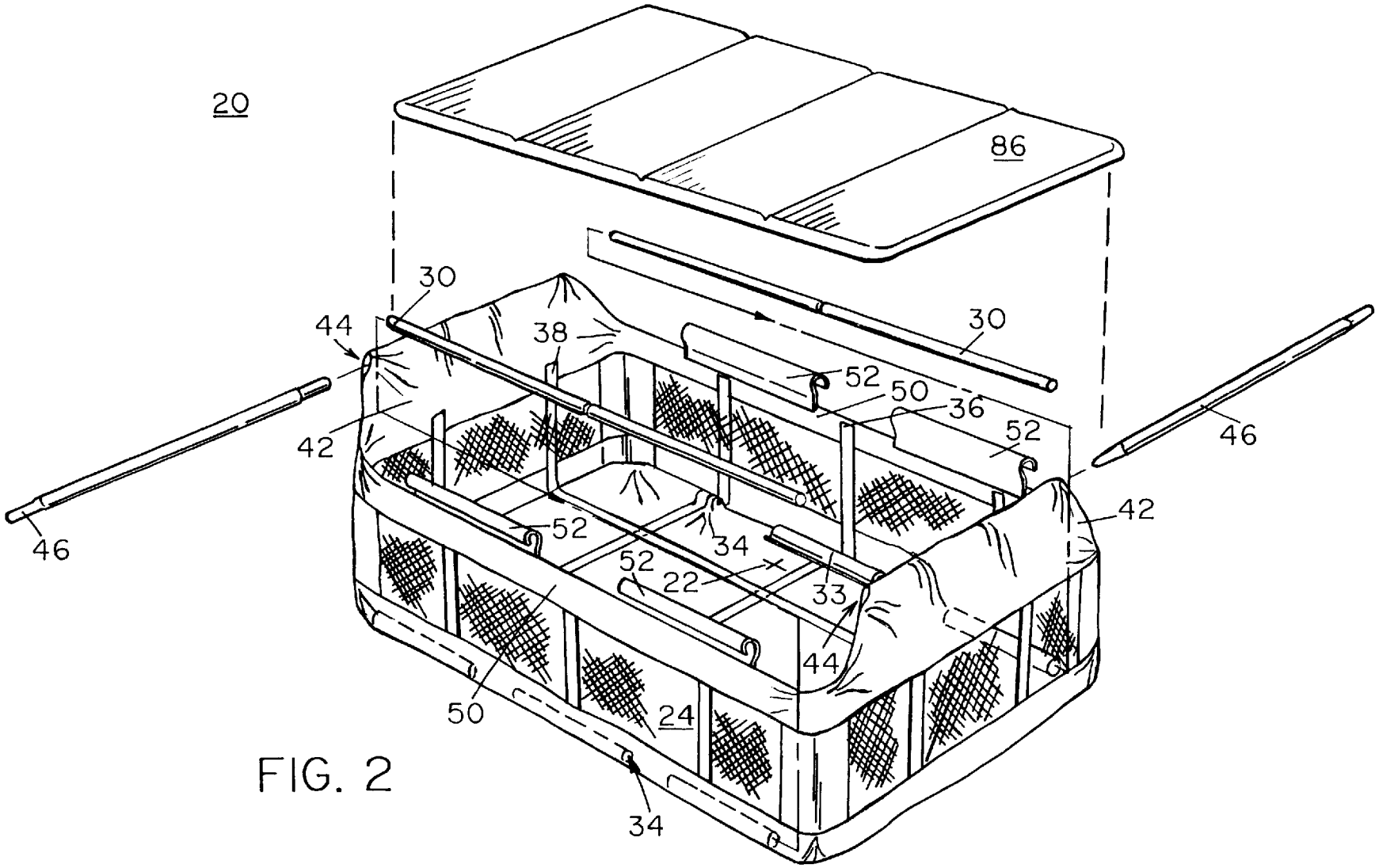
FIG. 2 is an exploded view of a bassinet constructed in accordance with the teachings of the instant invention.

A bassinet 20 constructed in accordance with the teachings of the invention is shown in FIGS. 1 and 2. The illustrated bassinet 20 includes a fabric floor 22, two mesh side panels 24, and two mesh end panels 26. The fabric floor 22, side panels 24, and end panels 26 define an interior pocket 28 suitable for receiving an infant.

To provide support to the fabric floor 22, the bassinet 20 is provided with floor support bars 30. These floor support bars 30 are held in place by fabric strips 32, which are sewn onto the fabric floor 22 to define tubes or tunnels 34. The bassinet 20 also includes criss-crossing support straps 36, 38 (FIG. 2). The sewn-in straps 36 run from one side mesh panel 24, along the fabric floor 22 and up the opposing side mesh panel 24. Similarly, the sewn-in support straps 38 run from one end mesh panel 26, along the fabric floor 22, and up the opposing end mesh panel 26.

The upper edges 40 of the end panels 26 contain fabric extensions 42. The fabric extensions 42 define suspension support tubes 44 in which suspension support rods 46 are disposed (FIG. 2). The upper edges 40 of the end panels 26 also include shape stabilizers 48 (FIG. 1). These shape stabilizers 48 prevent the mesh side panels 24 from collapsing into the interior pocket 28.

Figure 3:
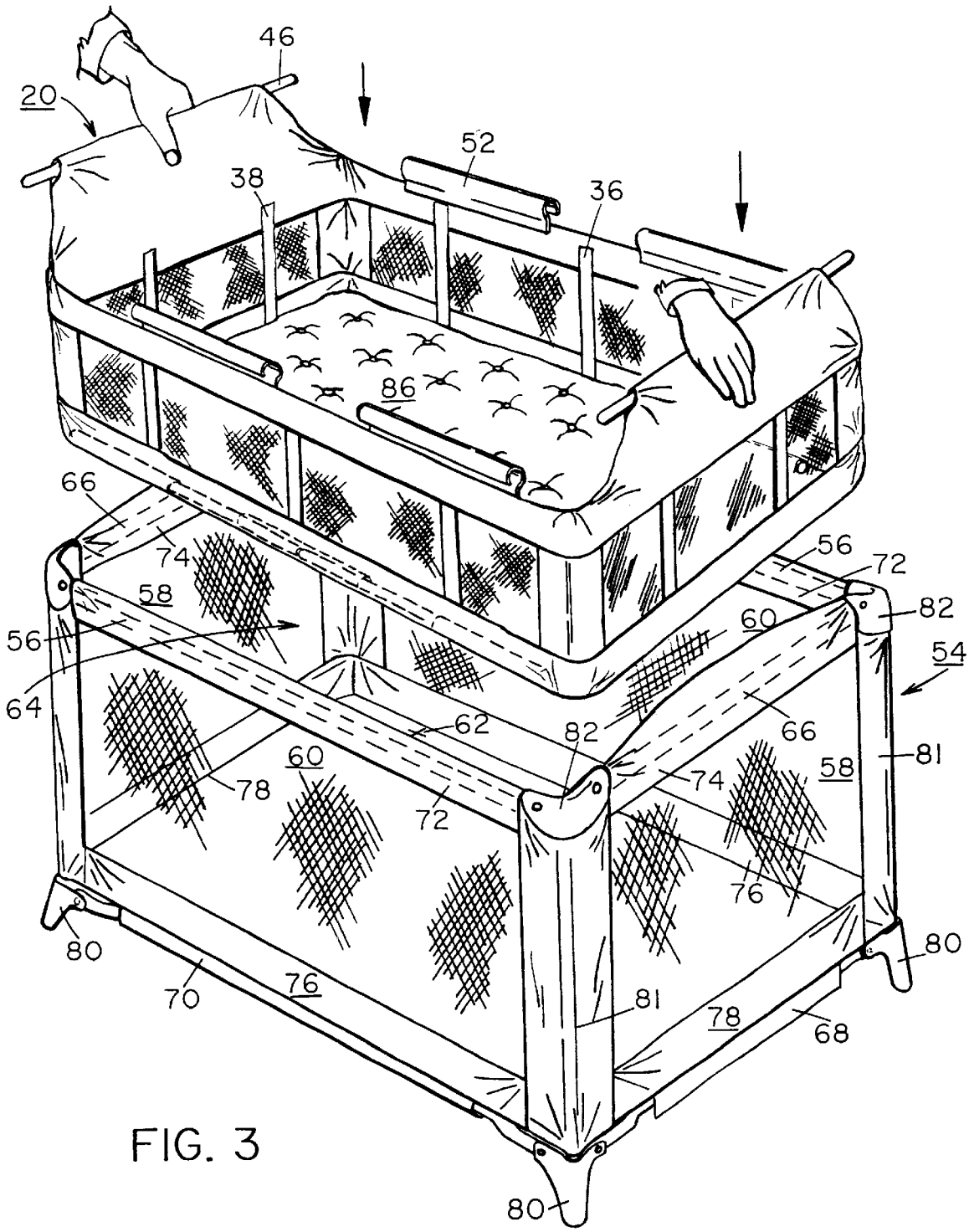
FIG. 3 is a perspective view of a bassinet in the process of being inserted into a play yard.
Figure 4:
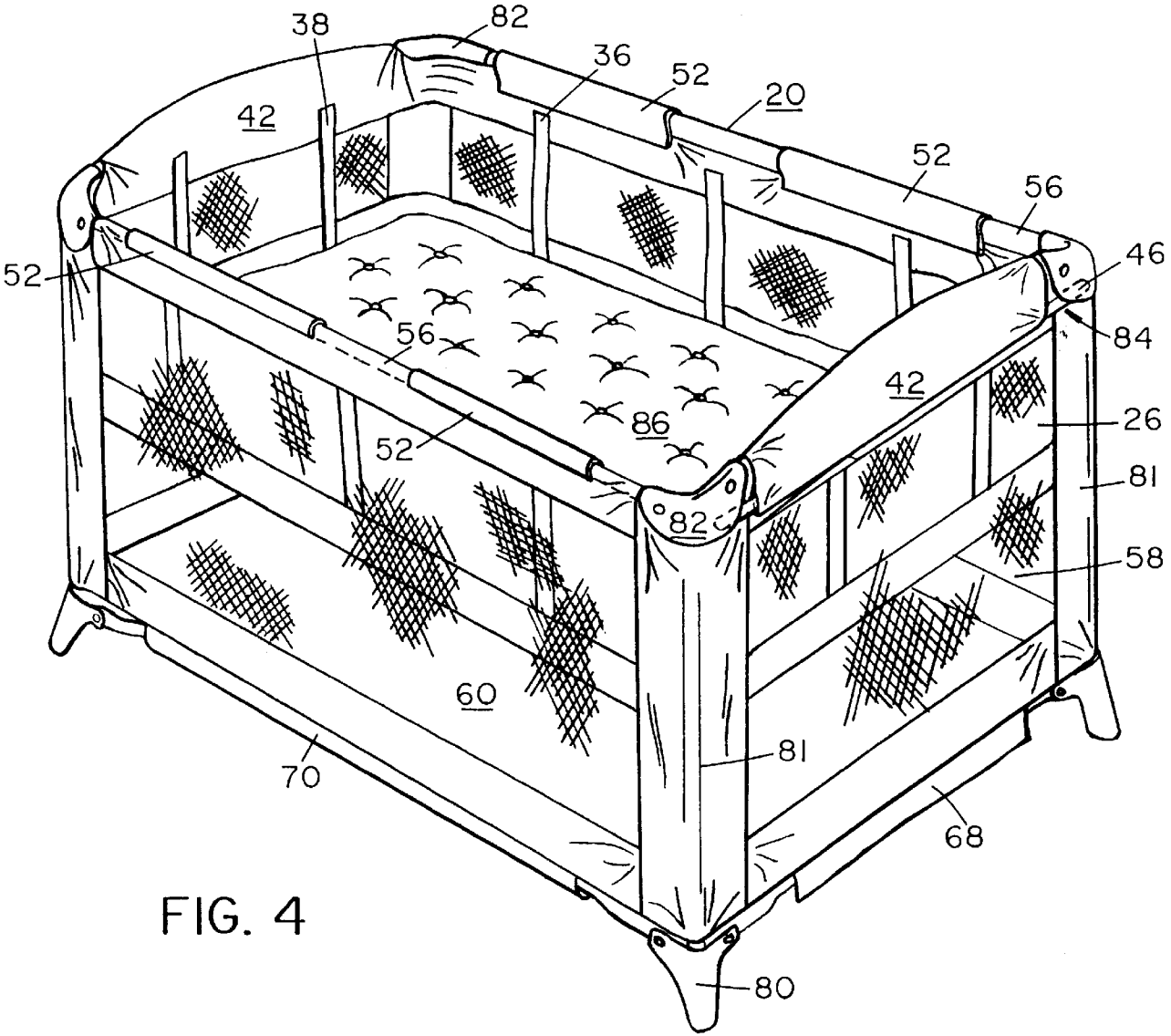
FIG. 4 is a perspective view of a play yard-bassinet combination constructed in accordance with the teachings of the instant invention.

The upper edges 50 of the side panels 24 include plastic clips 52. The clips 52 are used to attach the bassinet 20 to the play yard 54 as shown in FIGS. 3 and 4. The clips 52 have a C-shaped cross-section, and are sized to be easily attached to the upper rails 56 of the play yard 54.

The play yard 54 shown in FIGS. 3 and 4 includes two end mesh panels 58, two side mesh panels 60, and a fabric floor 62 that together define an interior volume or pocket 64. Support for the end mesh panels 58 is provided by end upper rails 66 and end lower rails 68. Support for the side mesh panels 60 is provided by side upper rails 56 and side lower rails 70. Side upper rails 56 run along the upper edges 72 of the side panels 60. End upper rails 66 run along the upper edges 74 of the end mesh panels 58. Likewise, the side lower rails 70 of the side panels 60 run along the lower edges 76 of the side panels 60. The end lower rails 68 of the end panels 58 run along the lower edges 78 of the end panels 58. When the play yard 54 is erected, the upper rails 56, 66 and lower rails 70, 68 are supported in substantially parallel planes by comer rails 81 which are mounted on legs 80.

Figure 5:
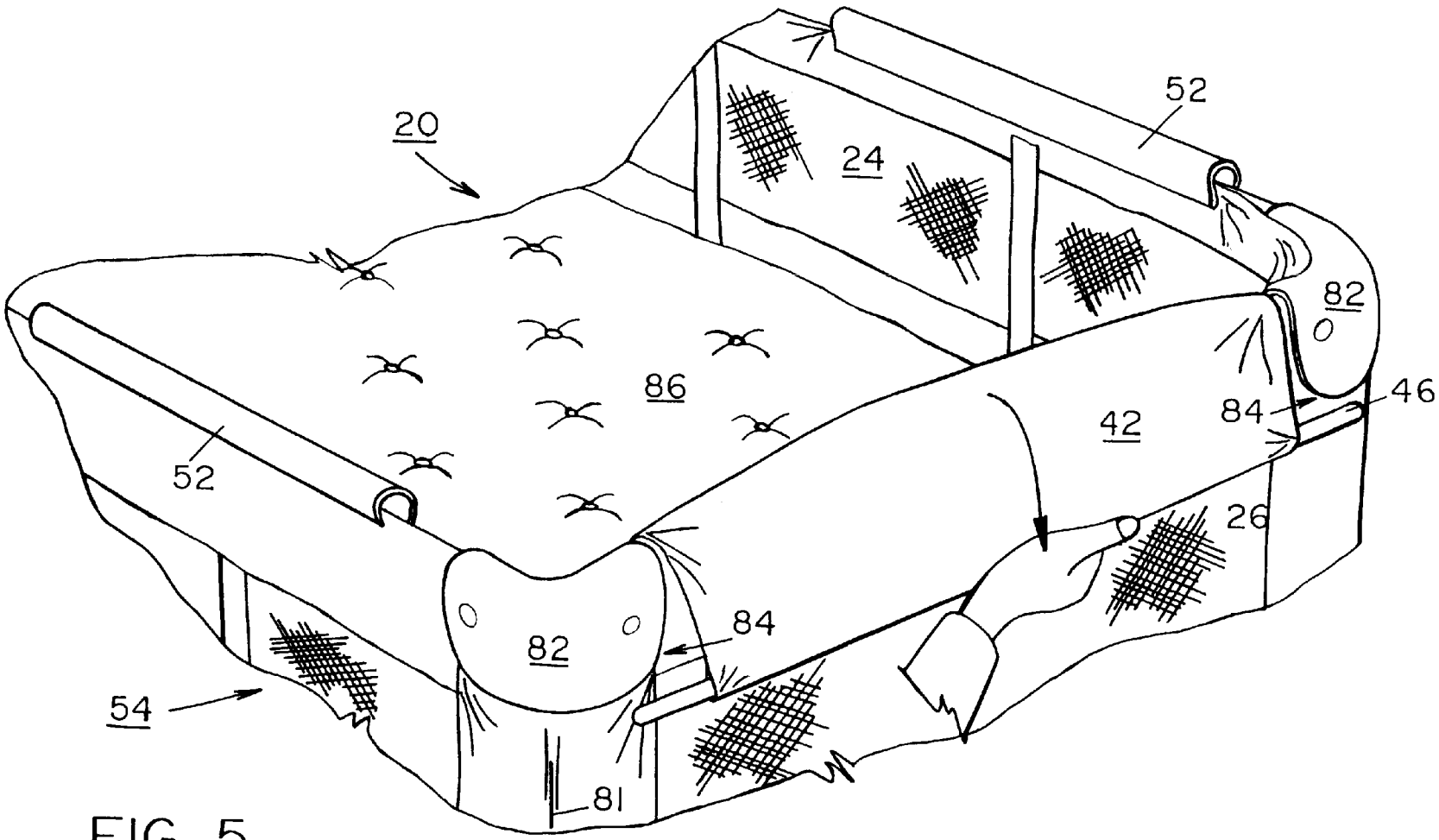
FIG. 5 is a partial perspective view of the play yard-bassinet combination of FIG. 4 showing a step in the process of securing the bassinet to the play yard.
Figure 6:
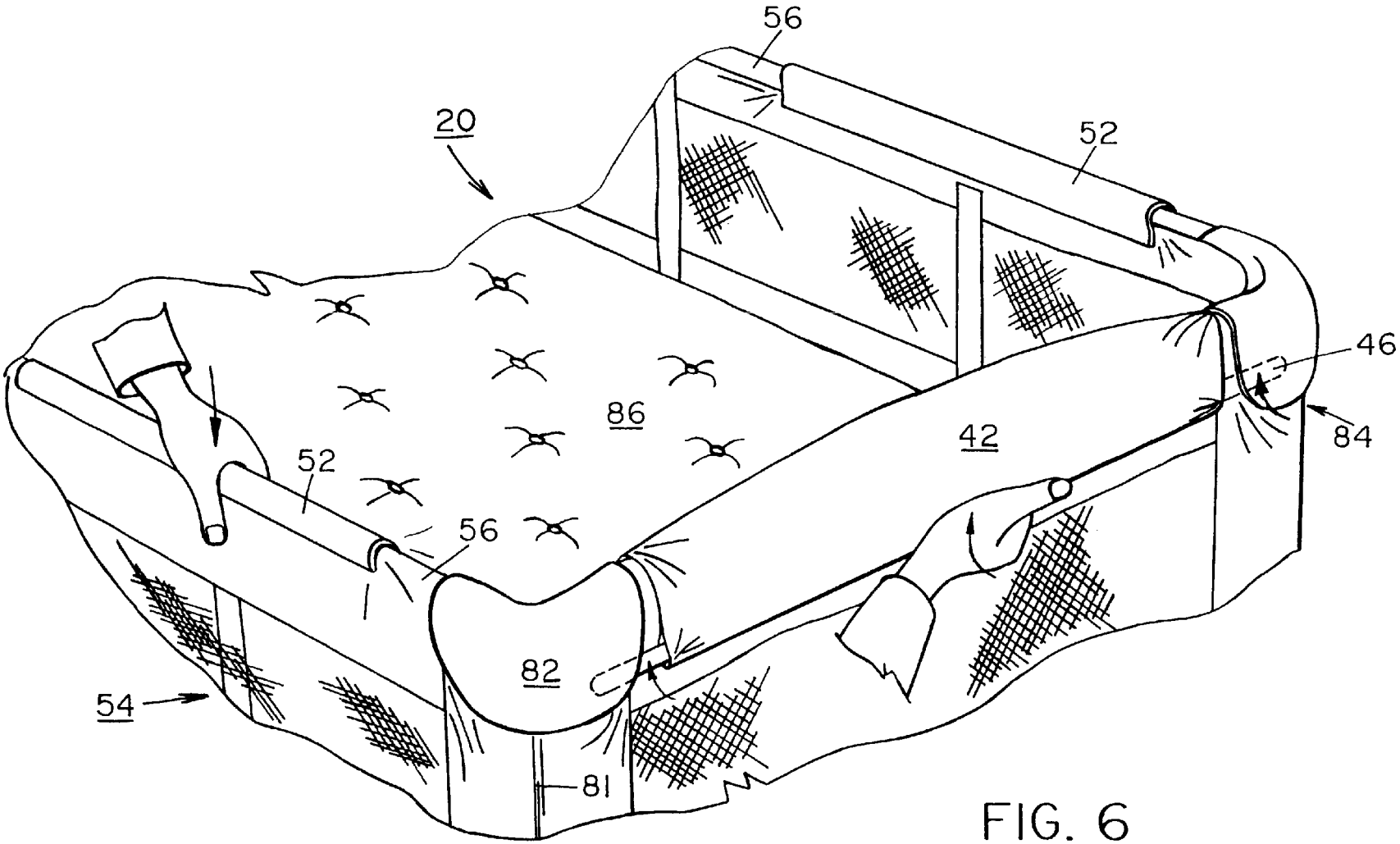
FIG. 6 is a partial perspective view of the play yard-bassinet combination of FIGS. 4–5 showing completion of the process of securing the bassinet to the play yard.

The comer rails 81, side upper rails 56, and end upper rails 66 are joined at comer cover plates 82. These cover plates 82 define channels 84 (FIGS. 5 and 6). The channels 84 are dimensioned to receive the opposite ends of the suspension support rods 46 of the bassinet 20.

To utilize bassinet 20, it is placed in the interior volume 64 of the erected play yard 54 (FIGS. 3 and 4). As shown in FIGS. 5 and 6, the bassinet 20 can be suspended in the interior volume 64 of the play yard 54 by coupling the clips 52 to their corresponding side rails 56 and by placing the fabric extensions 42 over the end upper rail 66 of the end mesh panels 58 of the play yard 54. The fabric extensions 42 have a length such that they can each rest upon a respective one of the upper edges 74 of the play yard 54 while their corresponding support rod 46 is inserted into the channels 84 of the corner cover plates 82 of the play yard 54. After the support rods 46 are properly disposed in the channels 84 of the corner cover plates 82, the bassinet 20 is suspended in the interior volume 64 of the play yard 54. The support rods 46, as shown in FIG. 6, are then moved upward into a locked position inside the channels 84. The weight of in the bassinet 20 has the effect of biasing the rods 46 into the channels 84 thereby ensuring the bassinet 20 remains in secure engagement with the channels 84 of the corner cover plates 82 of the play yard 54. With the bassinet 20 securely suspended on all four sides, a removable padded floor 86 can be placed in the pocket 28 where it rests on top of the fabric floor 22 and the floor support bars 30. The removable padded floor 86 is provided to give the infant added comfort when he/she is inside the bassinet 20.

Figure 7:
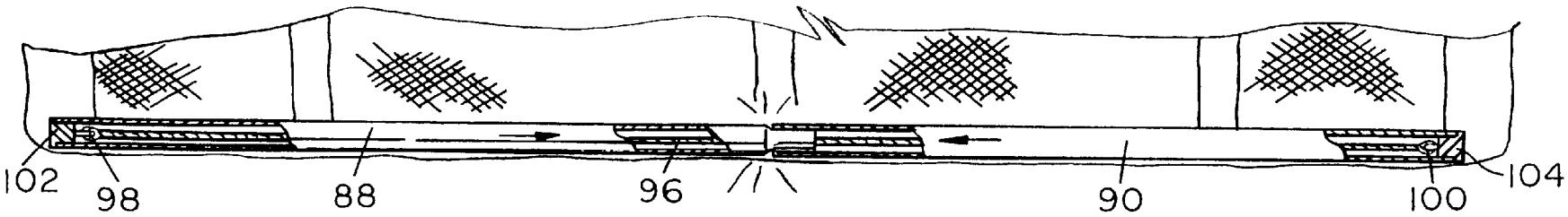
FIG. 7 is a cutaway side view of a floor support bar disposed in the floor of the bassinet.
Figure 8:
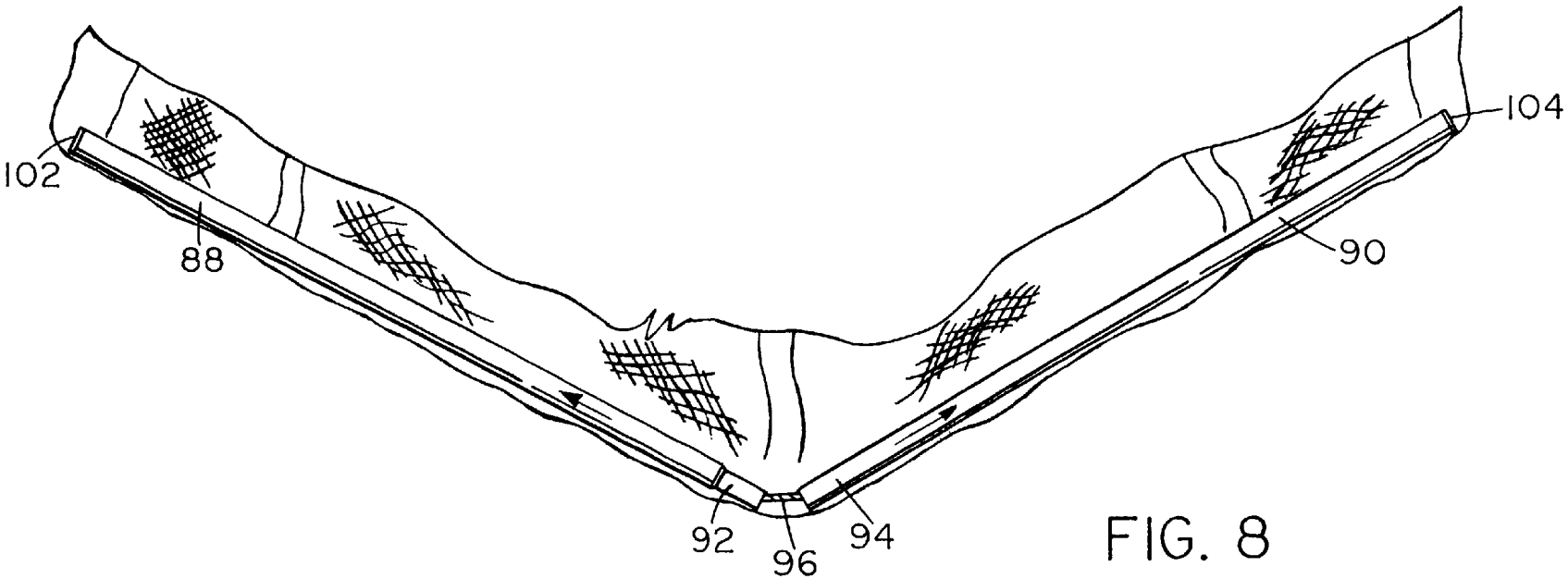
FIG. 8 is a cutaway side view of a floor support bar disposed in the floor of the bassinet in the process of being folded.

As shown in FIGS. 7 and 8, each floor support bar 30 comprises at least two separable portions, namely, a male portion 88 and a female portion 90. The male portion 88 has a slightly tapered end 92 that is slidably engagable with the open end 94 of the female portion 90. The male portion 88 and the female portion 90 are secured together by a spring element 96 disposed within the floor support bar 30. One end 98 of the spring element 96 is secured within the male portion 88 of the floor support bar 30. The opposite end 100 of the spring element 96 is secured within the female portion 90 of the floor support bar 30. The end 98 of the spring element 96 that is secured within the male portion 88 of the floor support bar 30 is attached at an end 102 opposite the tapered end 92. Likewise, the end 100 of the spring element 96 that is secured within the female portion 90 of the floor support bar 30 is attached at an end 104 opposite the open end 94. Of course different securing positions and different lengths of spring elements 96 can be utilized without departing from the scope or spirit of the invention.

As shown in FIG. 7, the spring constant, length and securing positions of the spring element 96 are selected such that the tension of the spring element 96 causes the tapered end 92 of the male portion 88 to matingly engage with the open end 94 of the female portion 90 when the two portions 88, 90 are in alignment. In order to disengage the portions 88, 90 of the floor support bar 30 the male portion 88 and the female portion 90 must be separated from one another by stretching the spring element 96 such that the tapered end 92 of the male portion 88 is no longer in contact with the open end 94 of the female portion 90 (FIG. 8). To maintain separation, the male portion 88 and female portion 90 must then be taken out of alignment, for example, by bringing the ends 102 and 104 into proximity with one another.

Preferably, the fabric cover 33 is sufficiently tightly fit to the two portions 88, 90 of the floor support bar 30 so that it functions to guide the two portions 88, 90 together. Of course, other ways of ensuring that, when the portions 88, 90 of the bar 30 are aligned, they automatically connect under the influence of the spring element 96 may be employed without departing from the scope or spirit of the invention.

The spring element 96 can be implemented in many ways without departing from the scope or spirit of the invention. For example, the spring element 96 can be implemented by an elastic cord as shown in the drawings. Preferably, however, the spring element 96 is implemented by a coil spring. Regardless of how the spring element 96 is implemented, it preferably functions to prevent the male and female portions 88, 90 of the support bars 30 from separating and to automatically pull the portions 88, 90 of the tubes 30 together into the interlocked position when they are aligned.

Preferably the support rods 30 are permanently fixed to the fabric floor 22. This permanent attachment can be achieved in many ways without departing from the scope or spirit of the invention. In the illustrated bassinet 20, the support rods 30 are fixed to the floor by partially entrapping it with the fabric strips which, together with the floor 22 itself, define tunnels 34. In the preferred implementation, the securement is further assisted by a screw connecting one end of rod 30 to the associated fabric strip 32. A similar approach is taken with respect to the extensions 42 and support rods 46. Specifically, one or more screws are utilized to permanently secure the support rods 46 within the suspension support tubes 44. This permanent securement of the rods 46 to the extensions 42 and the support rods 30 to the floor 22 is advantageous in the illustrated bassinet 20 because it eliminates the possibility of lost parts by ensuring all of the structural components (except, perhaps, the padded floor 86) remain connected whether the bassinet is erected or collapsed for storage.

Figure 9:
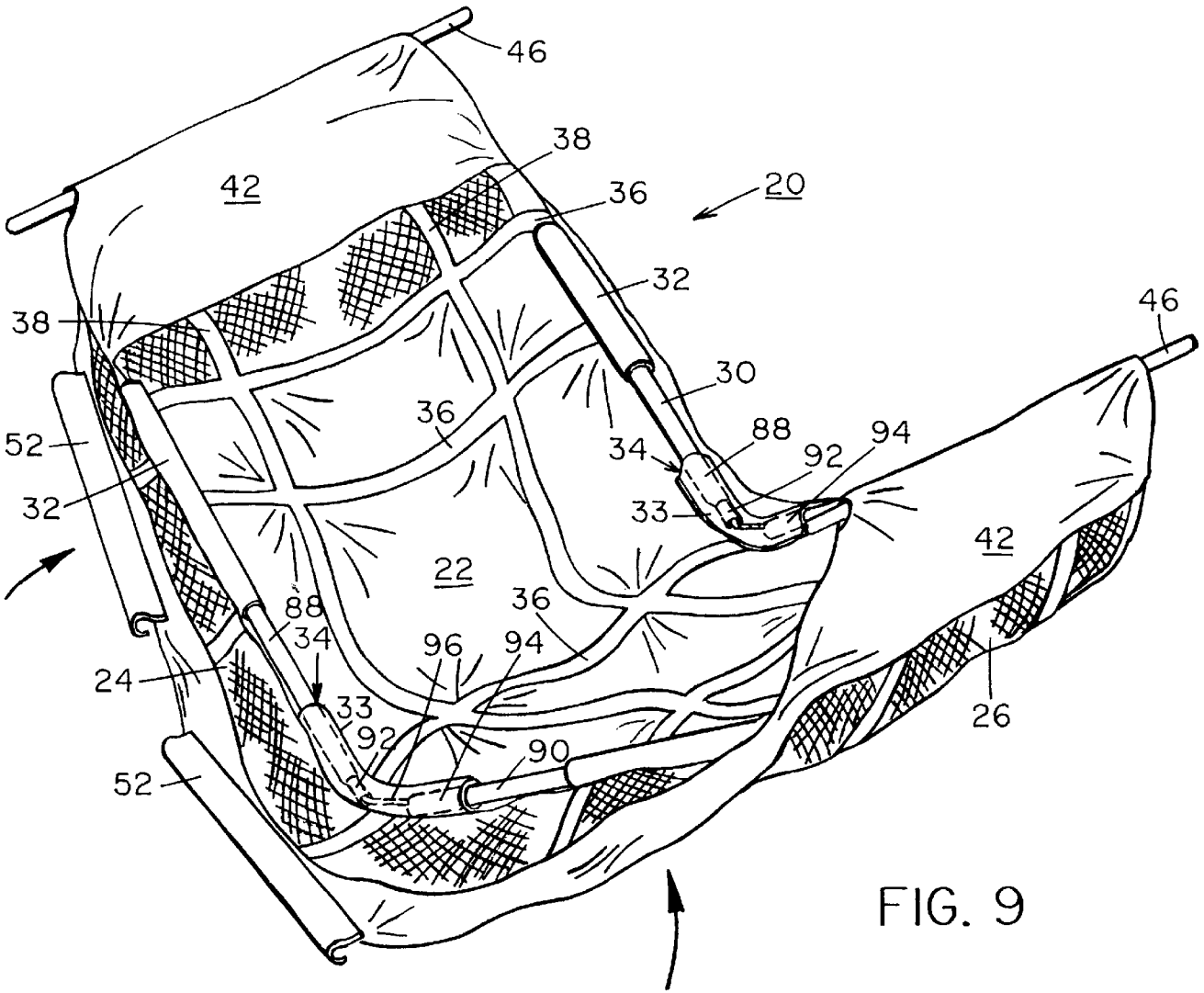
FIG. 9 is a perspective view of the floor support bars and the bassinet in the process of being folded.

As shown in FIGS. 1 and 9, each support bar 30 is preferably secured to the floor 22 by three fabric strips, namely, two end strips 32 and a middle strip 33. A space or separation is preferably provided between each end strip 32 and the middle strip 33. As a result, a section of each portion 88, 90 of the support bar 30 is exposed when the padded floor is removed to enable a user to grasp those portions 88, 90 for disassembling the support bar 30.

As shown in FIG. 1, the middle strip 33 is located over the joint between the separable portions 88, 90 of the support bar 30. Thus, the middle strip 33 functions as a joint cover to largely eliminate the pinch point formed by the joint. It also functions to align the portions 88, 90 of the support bar 30 and to prevent those portions 88, 90 from sliding laterally relative to the floor.

FIG. 9 illustrates the bassinet 20 in the process of being folded for portable storage. The male portions 88 of the floor support bars 30 are disengaged from the corresponding female portions 90. The ends 102, 104 of the floor support bars 30 are then brought into proximity with one another. Preferably, the bassinet 20 and the floor support bars 30 are constructed such that the floor support bars 30 can be disengaged while they are still disposed within the fabric tunnels 34. In the illustrated bassinet 20, the fabric nature of the walls 24, 26 and floor 22, and the length of the support bars enable such disengagement. Persons of ordinary skill in the art will, however, readily appreciate that the bassinet 20 can be constructed to permit and/or require removal of the floor support bar 30 from the tunnels 34 of the floor 22 for separating the male and female components 88, 90 of the floor support bars 30. It is preferred, however, that the support bars 30 be sealed within the floor tunnels 34 to reduce the likelihood of lost parts and/or misuse of the bassinet.

From the foregoing, persons of ordinary skill in the art will readily appreciate that the illustrated bassinet advantageously includes permanently affixed support bars 30. To permit enhanced collapsibility of the bassinet 20, the support bars 30 include at least partially separable sections or segments.

These segments are adapted to automatically align and engage one another to form the rigid support bars 30 when the bassinet 20 is put on a play yard and/or the floor 22 is flattened.

Persons of ordinary skill in the art will further appreciate that, when assembled, except for the padded floor, all of the structural members (e.g., the support tubes 30, 46) of the bassinet 20 are inaccessible to an infant disposed in the bassinet 20.

Although certain floor supports and bassinets constructed in accordance with the teachings of the invention have been described herein, the scope of coverage of this patent is not limited thereto. On the contrary, this patent covers all embodiments of the teachings of the invention fairly falling within the scope of the appended claims either literally or under the doctrine of equivalents.

What is claimed is:

1. A portable, collapsible bassinet for suspension within a play yard, said bassinet comprising:

a plurality of walls, each of the walls having a base edge and a free edge;

a floor, each of the walls being attached to the floor and extending upward to define a pocket suitable for receiving an infant; and at least one floor support bar secured to the floor within the pocket, the at least one support bar including at least two separable portions, the at least two separable portions of the at least one support bar being permanently secured together with a spring element.

2. A bassinet as defined in claim 1, wherein the floor further comprises at least one tunnel in which the at least one floor support bar is disposed.

3. A bassinet as defined in claim 1, wherein the spring element comprises at least one of an elastic cord and a coil spring.

4. A bassinet as defined in claim 1, wherein the spring element is located internal to the at least two separable portions of the at least one floor support bar.

5. A bassinet as defined in claim 4, wherein the at least one support bar can be at least partially disassembled by elongating the spring element to disengage the at least two portions of the bar, and by moving at least one of the portions relative to at least one other of the portions.

6. A bassinet as defined in claim 1, wherein the portions of the at least one floor support bar can be brought into side-by-side relation to reduce the size of the bassinet during storage.

7. A bassinet as defined in claim 1, wherein at least two of the walls further comprise extensions, each of the extensions having a free end and a suspension support tube attached to the free end, the support tubes being adapted for engaging a play yard.

8. A bassinet as defined in claim 7, wherein at least one of the walls further comprises a clip for engaging a play yard.

9. A bassinet as defined in claim 1, further comprising a removable padded floor disposed within the pocket on top of the floor and the at least one portable floor support bar.

10. A bassinet as defined in claim 1, wherein the walls and floor are fabric.

11. A bassinet as defined in claim 1, wherein the at least one support bar is permanently secured to the floor.

12. A bassinet as defined in claim 7, wherein the at least one support bar is permanently secured to the floor and the support tubes are permanently secured to the extensions.

13. A bassinet as defined in claim 1, wherein the at least two separable portions of the at least one support bar automatically lock into engagement with one another when the bassinet is erected.

14. A bassinet as defined in claim 7 wherein the at least one support bar and the support tubes are inaccessible to an infant in the bassinet when the bassinet is erected.

15. An apparatus comprising:

a play yard including a collapsible frame;

a plurality of fabric walls supported by the frame, each of the walls having a base edge and a free edge;

a play yard floor supported by the frame, each of the fabric walls extending upward from the play yard floor to define a volume;

a portable, collapsible bassinet comprising:

a plurality of bassinet walls, each of the bassinet walls having a base edge and a free edge;

a bassinet floor, each of the bassinet walls extending upward from the bassinet floor to define a pocket suitable for receiving an infant; and at least one floor support bar coupled to the bassinet floor, the at least one support bar including at least two separable portions, the at least two separable portions of the at least one support bar being permanently secured together with a spring element.

16. An apparatus as defined in claim 15, wherein the bassinet is suspended in the volume.

17. An apparatus as defined in claim 15, wherein the fabric walls of the play yard are attached to one another.

18. An apparatus as defined in claim 15, wherein the bassinet floor further comprises at least one tunnel in which the at least one floor support bar is disposed.

19. A bassinet as defined in claim 15, wherein the spring element comprises at least one of an elastic cord and a coil spring.

20. An apparatus as defined in claim 15, wherein the spring element is located internal to the at least two separable portions of the at least one floor support bar.

21. An apparatus as defined in claim 20, wherein the at least one support bar can be at least partially disassembled by elongating the spring element to disengage the portions of the bar, and by moving a first one of the portions relative to a second one of the portions.

22. An apparatus as defined in claim 21, wherein the portions of the at least one floor support bar can be brought into side-by-side relation to reduce the size of the bassinet during storage.

23. An apparatus as defined in claim 15, wherein at least two of the bassinet walls further comprise:

(a) extensions that extend to a free end; and (b) a suspension support tube attached to the free end for engaging the play yard.

24. An apparatus as defined in claim 23, wherein the play yard further comprises corner cover plates, each of the comer cover plates having an inside and an outside surface and being attached to the frame where the free edges of the fabric walls are connected to one another.

25. An apparatus as defined in claim 24, wherein the inside and outside surfaces of the comer cover plates define a channel suitable for receiving at least a portion of the suspension support tube.

26. An apparatus as defined in claim 15, wherein at least one of the bassinet walls further comprises a clip for engaging a play yard.

27. An apparatus as defined in claim 15, further comprising a removable padded floor disposed within the pocket on top of the bassinet floor and the at least one floor support bar.

28. An apparatus as defined in claim 15, wherein the bassinet walls and the bassinet floor comprise fabric.

29. An apparatus as defined in claim 15, wherein the at least one support bar is permanently secured to the floor.

30. An apparatus as defined in claim 23, wherein the at least one support bar is permanently secured to the floor and the support tubes are permanently secured to the extensions.

31. An apparatus as defined in claim 15, wherein the at least two separable portions of the at least one support bar automatically lock into engagement with one another when the bassinet is erected.

32. An apparatus as defined in claim 23 wherein the at least one support bar and the support tubes are inaccessible to an infant in the bassinet when the bassinet is erected.

33. A bassinet as defined in claim 1 further comprising at least one cover disposed where the at least two separable portions of the at least one support bar engage one another to cover a pinch point between the at least two separable portions.

34. A bassinet as defined in claim 33 wherein the cover ensures alignment between the at least two separable portions of the at least one support bar.

35. An apparatus as defined in claim 15 further comprising at least one cover disposed where the at least two separable portions of the at least one support bar engage one another to cover a pinch point between the at least two separable portions.

36. An apparatus as defined in claim 35 wherein the cover ensures alignment between the at least two separable portions of the at least one support bar.

37. A portable, collapsible bassinet for suspension within a play yard, said bassinet comprising:

a plurality of walls, each of the walls having a base edge and a free edge;

a floor, each of the walls being attached to the floor and extending upward to define a pocket suitable for receiving an infant; and at least one floor support bar secured to the floor, the at least one support bar including at least two separable portions, the at least two separable portions of the at least one support bar being permanently secured together with a spring element, wherein at least two of the walls further comprise extensions, each of the extensions having a free end and a suspension support tube attached to the free end, the support tubes being adapted for engaging a play yard.

38. A bassinet as defined in claim 37, wherein at least one of the walls further comprises a clip for engaging a play yard.

39. A bassinet as defined in claim 37, wherein the at least one support bar is permanently secured to the floor and the support tubes are permanently secured to the extensions.

40. A bassinet as defined in claim 37 wherein the at least one support bar and the support tubes are inaccessible to an infant in the bassinet when the bassinet is erected.

41. A portable, collapsible bassinet for suspension within a play yard, said bassinet comprising:

a plurality of walls, each of the walls having a base edge and a free edge;

a floor, each of the walls being attached to the floor and extending upward to define a pocket suitable for receiving an infant; and at least one floor support bar secured to the floor at a location spaced inwardly from at least two of the walls, the at least one support bar including at least two separable portions, the at least two separable portions of the at least one support bar being permanently secured together with a spring element.

42. A portable, collapsible bassinet for suspension within a play yard, said bassinet comprising:

a fabric enclosure defining a pocket having a bottom;

a clip attached to the fabric enclosure to secure the enclosure to the play yard;

at least one floor support bar secured to the bottom of the pocket, the at least one support bar including at least two separable portions, the at least two separable portions of the at least one support bar being permanently secured together with a spring element; and a removable floor sized for positioning within the pocket vertically above the at least one floor support.

* * * * *

UNITED STATES PATENT AND TRADEMARK OFFICE

CERTIFICATE OF CORRECTION

PATENT NO. : 6,434,767 B1
DATED : August 20, 2002
INVENTOR(S) : Thomas J. Welsh, Jr.

It is certified that error appears in the above-identified patent and that said Letters Patent is hereby corrected as shown below:

Column 6,
Lines 44 and 48, replace “comer cover” with -- corner cover --.

Signed and Sealed this

Eighteenth Day of February, 2003

JAMES E. ROGAN
*Director of the United States Patent and Trademark Office*